US006191346B1

(12) United States Patent
Swan

(10) Patent No.: US 6,191,346 B1
(45) Date of Patent: Feb. 20, 2001

(54) STRINGED INSTRUMENT

(76) Inventor: Terry Martin Swan, 48 Fellows Road, Nottingham (GB), NG9 1AQ ( * ) Notice: Under 35 U.S.C. 154(b), the term of this patent shall be extended for 0 days.

(21) Appl. No.: 09/337,265

(22) Filed: Jun. 22, 1999

(51) Int. Cl.[7] ..... G10D 3/04
(52) U.S. Cl. ..... 84/307; 84/723
(58) Field of Search ..... 84/723, 730–731, 84/298–299, 307, 308, 309, DIG. 24, 725, 726

(56) References Cited

U.S. PATENT DOCUMENTS

| | | | | |
|---|---|---|---|---|
| 3,797,355 | * | 3/1974 | Law | 84/273 |
| 4,314,495 | * | 2/1982 | Baggs | 84/1.16 |
| 4,738,178 | | 4/1988 | Deering . | |
| 5,189,771 | * | 3/1993 | Fishman | 29/25.35 |
| 5,223,660 | * | 6/1993 | Wahlgreen | 84/731 |
| 5,319,153 | * | 6/1994 | Fishman | 84/731 |
| 5,408,043 | * | 4/1995 | Lace | 84/426 |
| 5,567,903 | * | 10/1996 | Coopersmith et al. | 84/723 |
| 5,670,733 | * | 9/1997 | Fishman | 84/731 |
| 5,877,447 | * | 3/1999 | Vice | 84/730 |
| 5,908,998 | * | 6/1999 | Blucher | 84/728 |
| 5,911,171 | * | 6/1999 | Wong | 84/731 |

FOREIGN PATENT DOCUMENTS

97/04444 2/1997 (WO) .

* cited by examiner

*Primary Examiner*—Robert E. Nappi
*Assistant Examiner*—Kim Lockett
(74) *Attorney, Agent, or Firm*—James Creighton Wray; Meera P. Narasimhan

(57) ABSTRACT

A stringed musical instrument is disclosed, taking the form of a banjo in the preferred embodiment. Securing means 205 are provided for securing ends of strings 203 and a bridge 206 supports the strings to facilitate the playing of the instrument. The bridge is supported by a flexible sheet-like material 302 to facilitate the production of the distinctive banjo sound. Transducers 403 and 404 are placed in physical contact with the sheet-like material and physical properties of the material are configured so as to reduce the influence of ambient acoustics when compared to an exclusively acoustic instrument. In this way, a substantially banjo-like sound can be produced when an electrical signal derived from the transducers is amplified.

26 Claims, 6 Drawing Sheets

STRINGED INSTRUMENT

FIELD OF THE INVENTION

The present invention relates to a stringed instrument having securing means for securing ends of said strings and a bridge supporting said strings.

INTRODUCTION TO THE INVENTION

Many stringed musical instruments are known that have securing means for securing the ends of strings, one end of which usually being at the end of a fret board. In addition, in order to accurately determine the length of the vibrating strings, it is known for a bridge to be provided for supporting the strings. Given this basic instrument configuration, there are many variations that may be made in order to facilitate the playing of the instrument and in order to provide a variety of musical textures and timbres.

One such example of an instrument of this type is the banjo; which may be regarded as an instrument characterised by a bridge supported by a flexible sheet-like structure, such as an organic membrane or a similar structure fabricated from man-made materials.

The purpose of the sheet-like structure is to provide a degree of resonance thereby enhancing the volume of the acoustic sounds produced by the vibrating strings and in order to introduce a unique and distinctive timbre to the notes produced by the instrument.

In recent years, there has been a trend towards providing electronic amplification and many instruments, such as electric guitars and electronic keyboards etc, are specifically designed to be played within a highly amplified environment; to the extent that these instruments provide no or very little actual acoustic output. In these situations, it becomes virtually impossible for acoustic instruments to be included within an ensemble including predominantly amplified instruments unless the acoustic instruments can also be provided with a degree of amplification.

Many forms of amplification are known, including transducer pick-ups suitable for enhancing acoustic signals. However, a problem encountered with instruments of the type, in which an acoustic sheet-like resonating structure is provided, is that the sheet will tend to resonate in response to external acoustic signals, which may be introduced at a relatively high amplitude particularly if the instrument is surrounded by, or is in the vicinity of, amplification systems. Thus, under such circumstances, any microphones or transducers associated with the instrument and positioned so as to allow amplification of the instrument will also result in the amplification of external sound sources which will then very quickly develop in to a situation in which the amplified signals of the instrument itself are fed back, resulting in the well known screech or squeal of a positive feed-back loop.

The problems associated with instruments of this type can be limited or possibly removed by making adjustments to the configuration of any microphones or transducers with respect to the flexible sheet-like structure. However, under these circumstances, known instruments produce amplified output signals that convey little resemblance to the desired acoustic sound, such that little is then gained from using an instrument of this type.

SUMMARY OF THE INVENTION

According to a first aspect of the present invention, there is provided a stringed musical instrument having securing means for securing ends of said strings and a bridge for supporting said strings, wherein said bridge is supported by a flexible sheet-like structure; at least one transducer is placed in physical contact with said sheet-like structure; and physical properties of said membrane are configured so as to reduce the influence of ambient acoustics.

DETAILED DESCRIPTION OF THE PREFERRED EMBODIMENTS

The invention will now be described by way of example only with reference to the previously identified drawings.

The stringed musical instrument described herein is designed to produce a musical output substantially similar to that of a conventional banjo. However, modifications have been made in accordance with the present invention in order to facilitate the electrical amplification of the musical instrument thereby facilitating its introduction into ensembles or groups with amplified instruments. This type of instrument, of which the banjo is an example, is distinguished by being provided with a bridge that is supported by a flexible sheet-like structure, said structure being provided so as to resonate in sympathy with the vibrating strings and thereby introduce a distinctive timbre to the musical notes produced by the instrument.

Figure 1:
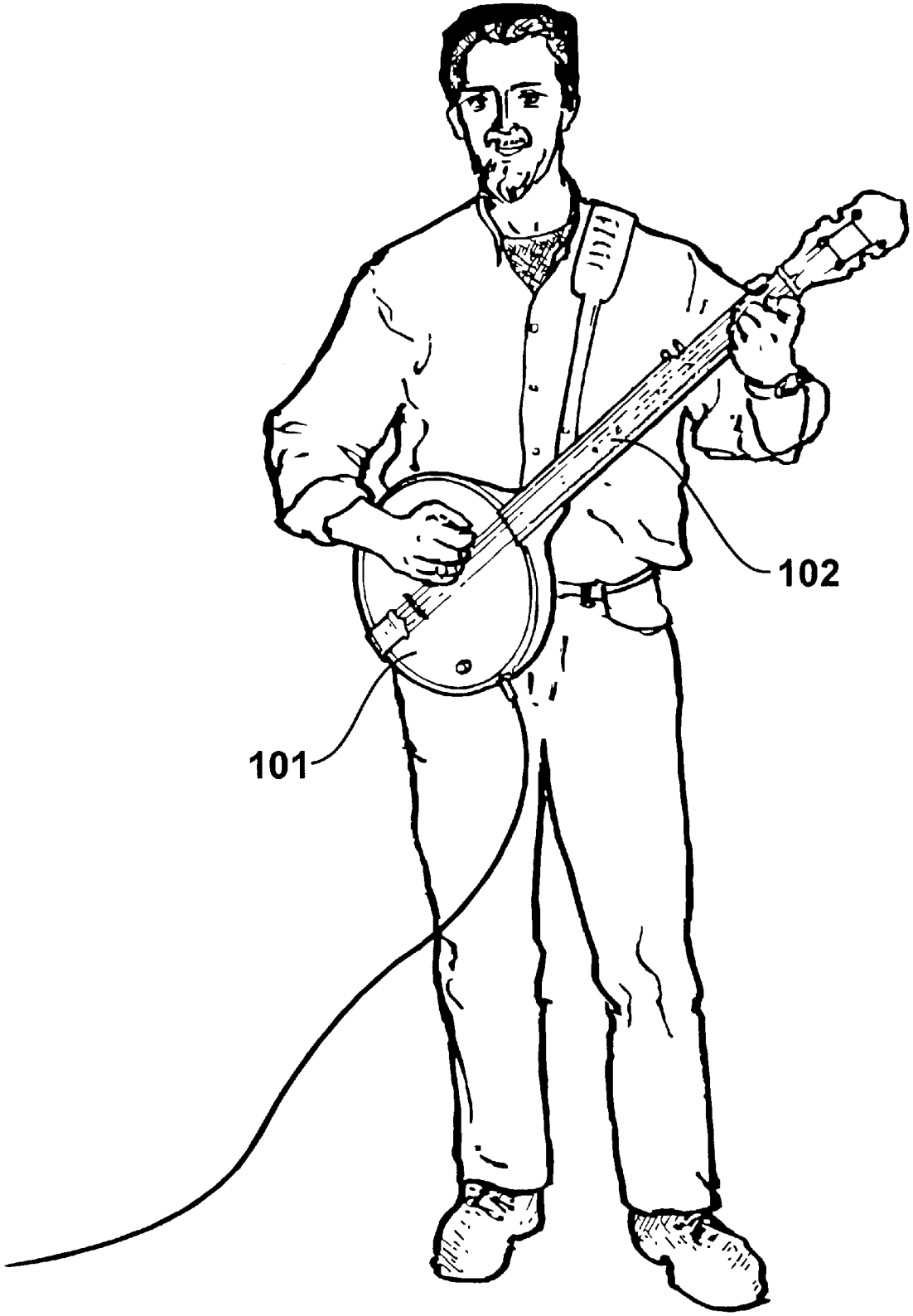
FIG. 1 shows a banjo embodying the present invention being played in a substantially conventional way.

A banjo embodying the present invention is shown in FIG. 1. The banjo comprises a main body housing 101 and a neck 102 along which strings are configured in a displaced orientation so as to facilitate note selection by the application of fingerings upon frets. Notes are then played by plucking strings in the region of the main body 101 and the resulting timbre of the instrument is produced by means of additional resonating materials which, in a conventional banjo, usually take the form of a stretched hide or similar membrane establishing an arrangement substantially similar to a drum-like structure.

Figure 2:
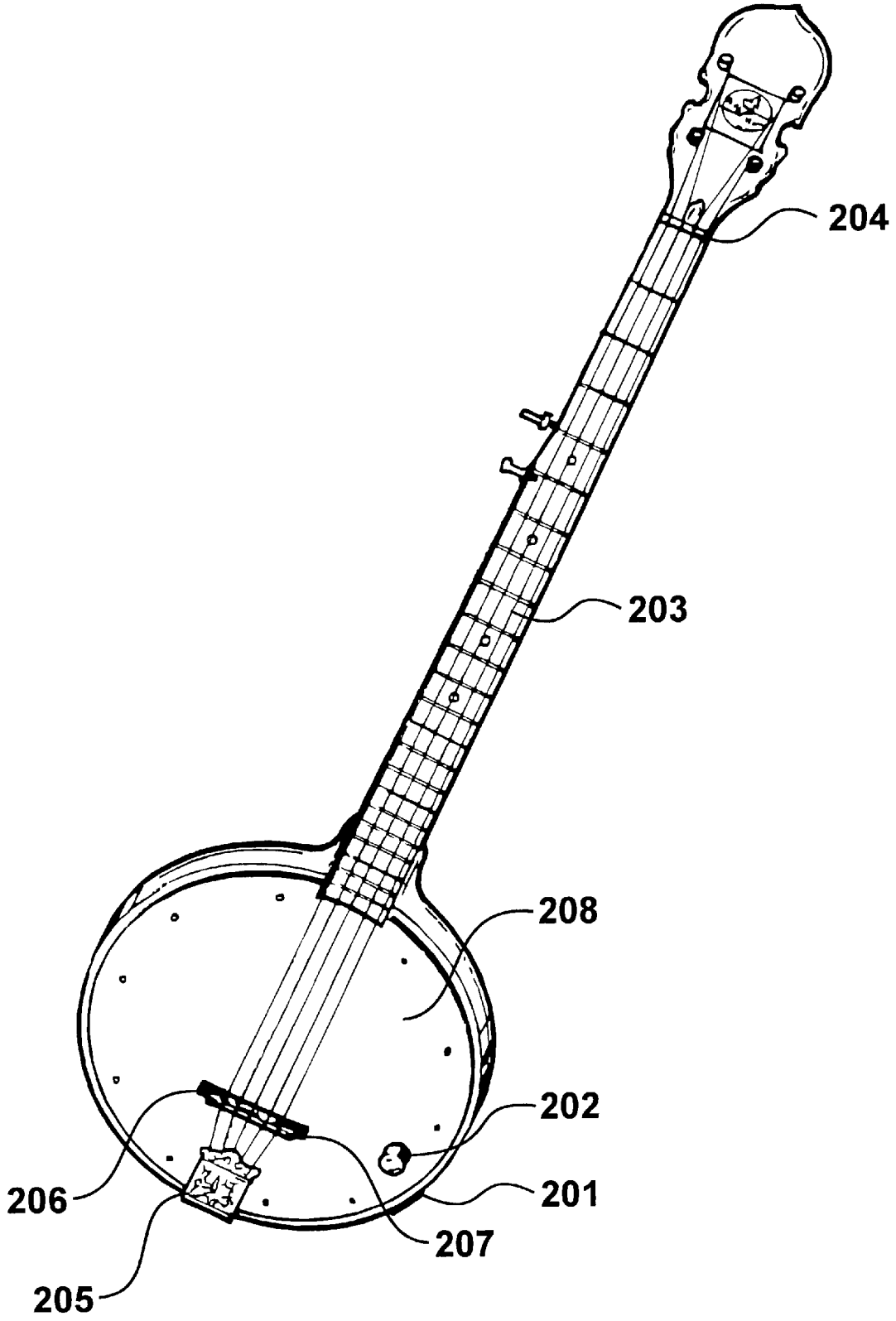
FIG. 2 details the banjo identified in FIG. 1, including a cover-plate.

The banjo of FIG. 1 is detailed in FIG. 2 and differs from conventional instruments of this type in that it is provided with an electrical jack socket 201 providing an electrical output to a conventional guitar amplifier or similar device. The output level from jack socket 201 is also controllable by means of a potentiometer 202.

Strings 203 are retained between a nut 204 and a similar rear securing element 205. The strings, secured between ends 204 and 205 are placed in tension and are supported by a bridge 206. The bridge 206 extends through a hole 207 of a cover-plate 208. In the example shown in FIG. 2, a control knob 202 for the potentiometer also extends through a similar hole in cover-plate 208.

The bridge 206 is not fixed to the body of the banjo and is effectively free to move; bridge arrangements of this type being referred to as a floating bridge.

Figure 3:
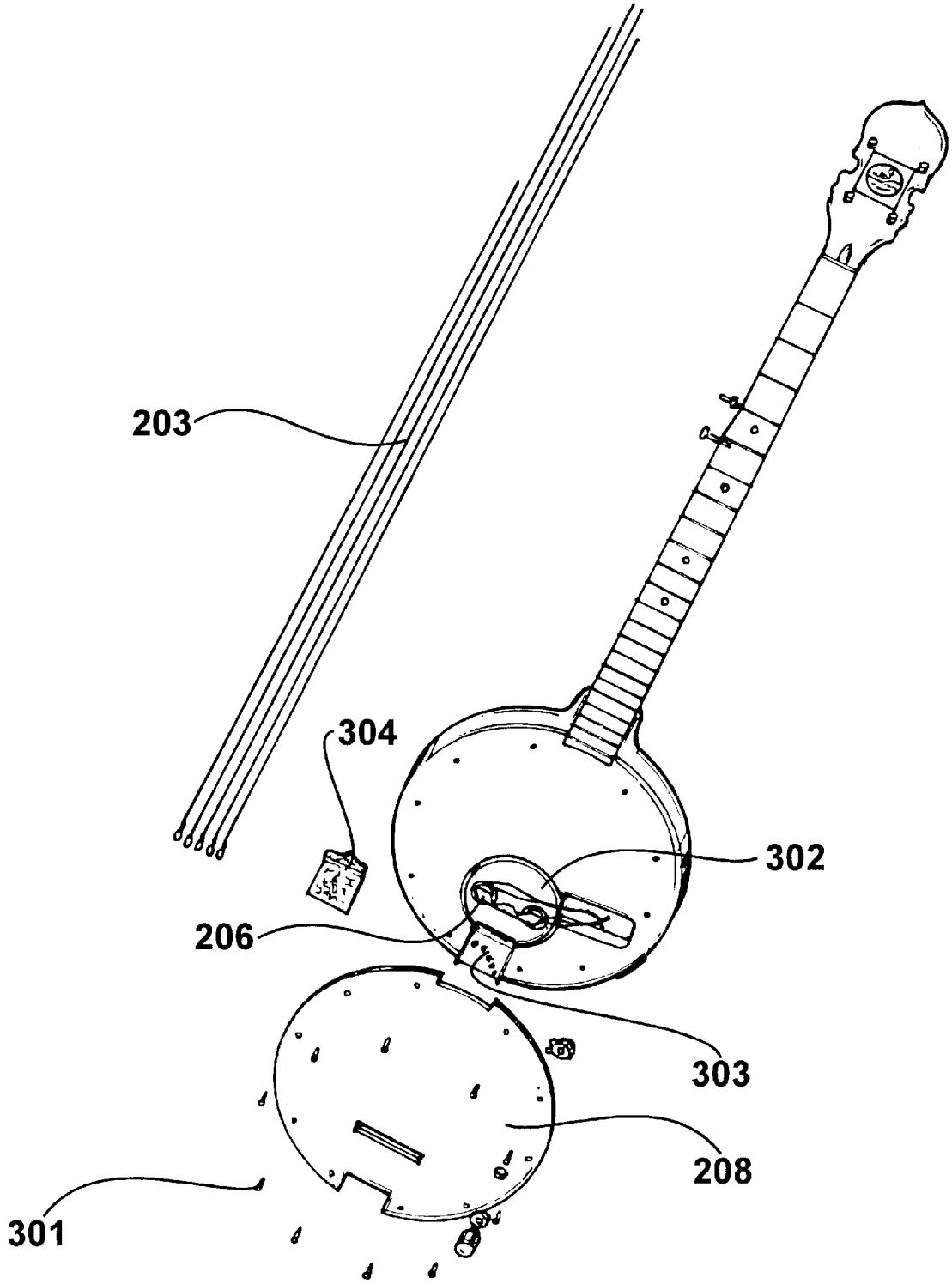
FIG. 3 shows the banjo of FIG. 2 with its strings and cover-plate removed, identifying internal amplifying components.

The banjo of FIG. 2 is shown in FIG. 3 with strings 203 and cover-plate 208 removed therefrom; cover-plate 208 being restrained by a plurality of screws 301.

In conventional banjos, the whole of the main body housing facilitates the application of a sheet-like material providing a resonating membrane, with a floating bridge being directly applied to said membrane. In the embodiment shown in FIG. 3, similar sheet-like membrane 302 is provided but of a substantially smaller size. Cover-plate 208 protects membrane 302 but the cover-plate itself does not form part of the sound generating arrangement.

Floating bridge 206 is supported by sheet-like material 302 but piezoelectric transducers are located between the bridge and the sheet-like material, thereby being securely held in place by said elements.

As shown in FIG. 3, the securing element 205 take the form of an anchor plate 303 and an anchor cover 304.

Figure 4:
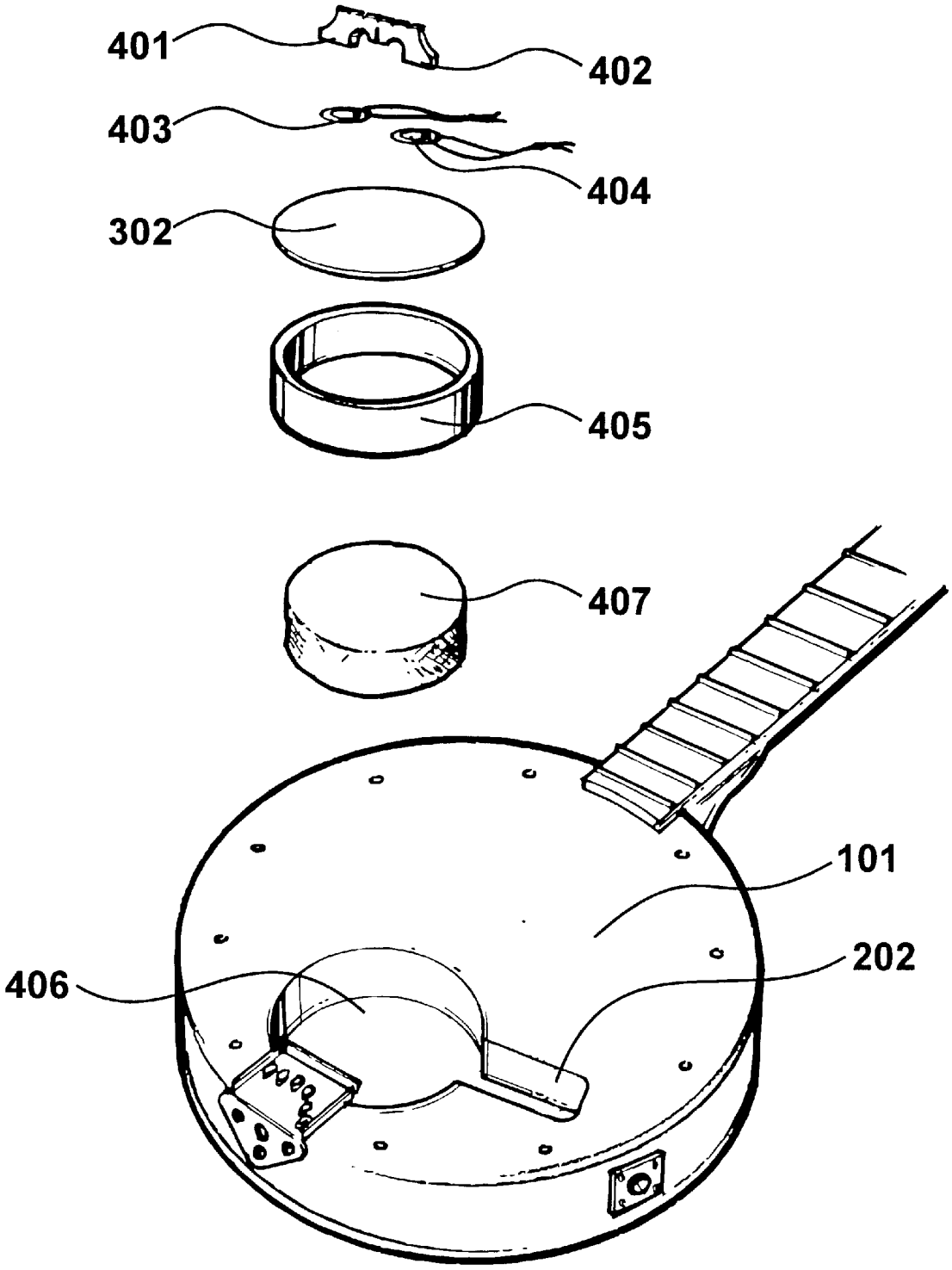
FIG. 4 details the internal amplifying components of the banjo shown in FIG. 3, including a resonating drum.

An exploded view of the components shown in FIG. 3 are detailed in FIG. 4. Floating bridge 206 may take the form of a substantially solid component that lays flat across the width of sheet-like material 302. However, preferably, the bridge has a first end support 401 and a second end support 402 such that a first transducer 403 is located below end support 401 and a second transducer 404 is located below the second end support 402. Transducers 403 and 404 are sold by Maplin under the designation Piezo/Xducer 27/1.8. The transducers are connected to potentiometer 202 in parallel, thereby improving electrical matching between the instrument output and a typical amplifier input.

Sheet-like material 302 is fabricated from high impact polystyrene with a width of typically two millimeters thus, it should be noted that this sheet-like material is significantly thicker than typical membranes in the construction of conventional banjos. The sheet-like material 302 is secured at its edges to a ring formed from moulded polyvinyl chloride such that, in combination, the polystyrene sheet-like material 302 and the PVC ring configuration 405 produce a resonating drum.

The resonating drum is retained within a well 406, cut into the main body 101 of the instrument. Optionally, a highly compressible sponge-like material 407 may be introduced within the resonating drum so as to soften the overall timbre of the instrument. However, it must be emphasised that material 407 should not come into contact with sheet-like resonating material 302. Material 407 may be secured to the bottom of well 406.

Figure 5:
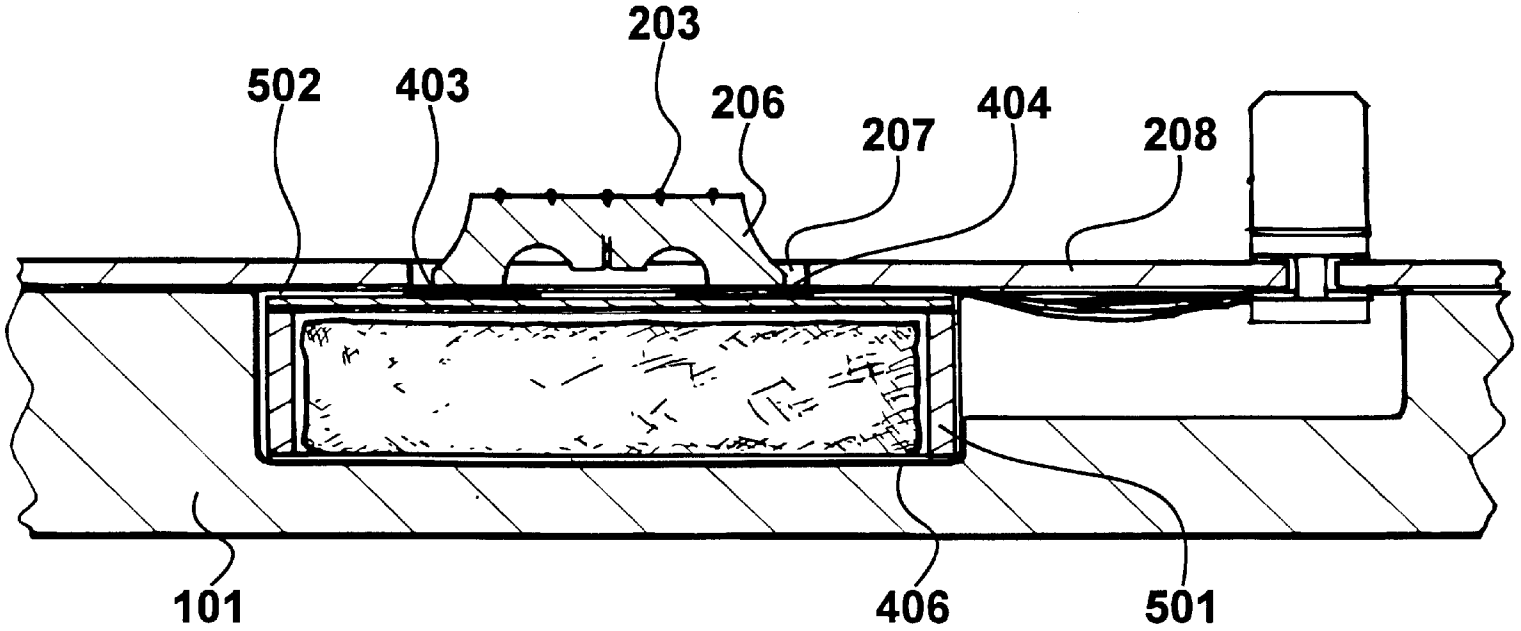
FIG. 5 shows a cross-section of the banjo identified in FIG. 2.

The complete banjo of FIG. 2 is shown in cross-section in FIG. 5. The strings 203, which are in tension, apply a downward force to the bridge 206. In turn, the bridge applies a downward force to the resonating drum 501, via the transducers 403 and 404. Therefore, the bridge, the transducers and the resonating drum are all held in compression between the strings and the bottom of the well 406.

The hole 207, is configured to allow space between the bridge and the sides of said hole. In addition, there is a gap 502 between the resonating drum and the cover plate 208. Therefore, the cover plate 208 is not in contact with any part of the sound generating arrangement.

Figure 6:
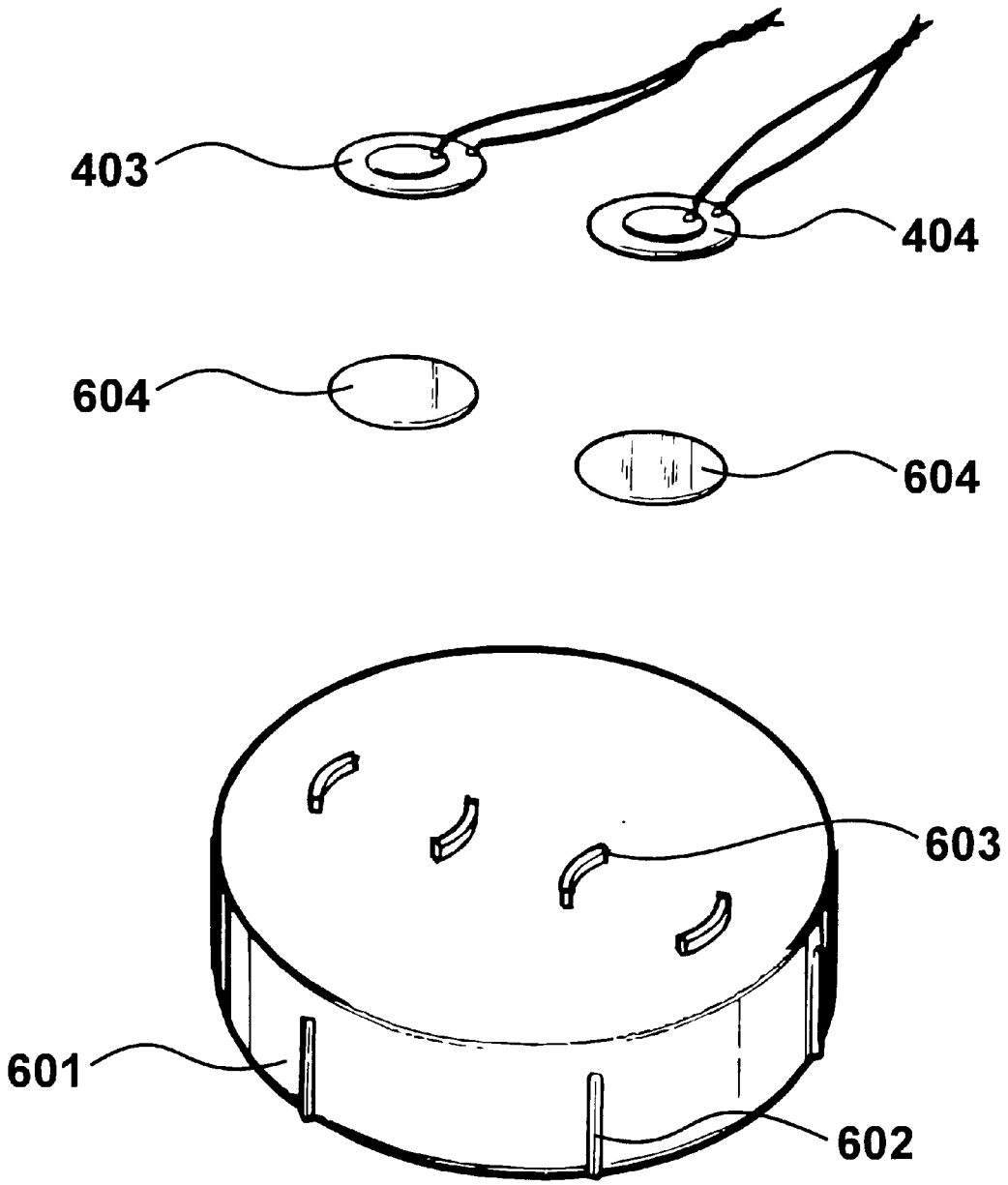
FIG. 6 details an alternative resonating drum, of the type identified in FIG. 4.

An alternative resonating drum to the type identified in FIG. 4 is detailed in FIG. 6. The alternative drum 601, is manufactured as a single component by the injection moulding of polystyrene. The drum 601, features six ridges 602, around its perimeter to facilitate a good fit in the well 406. In addition, there are provided four crescents 603 to enable repeatable positioning of the transducers 403 and 404. Two disks 604, of double-sided adhesive tape are also provided, as a means of securing the transducers to the drum 601.

What is claimed is:

1. A stringed musical instrument having a plurality of strings; means for securing ends of said strings and a floating bridge for supporting said strings, wherein said floating bridge is supported by a flexible membrane;

at least one transducer is held between said flexible membrane and said floating bridge; and physical properties of said membrane are configured so as to reduce the influence of ambient acoustics.

2. An instrument according to claim 1, wherein said bridge includes a plurality of supports, each supported by said membrane and said transducer or transducers are held between at least one of said supports and said sheet-like material.

3. An instrument according to claim 1, wherein said bridge includes end supports each supported by said membrane and said transducer is held between one of said supports and said membrane.

4. An instrument according to claim 3, wherein said bridge has two end supports and a respective transducer is positioned between each of said supports and said membrane.

5. An instrument according to claim 1, wherein the overall size of said membrane is smaller than a size of a similar acoustic instrument.

6. An instrument according to claim 1, wherein the thickness of the membrane is larger than a thickness of a similar acoustic instrument.

7. An instrument according to claim 1, wherein said membrane is fabricated from a plastics material.

8. An instrument according to claim 1, wherein said membrane is supported by a ringed structure to form a resonating drum.

9. An instrument according to claim 7, wherein said membrane is moulded in combination with a ringed structure to form a resonating drum as a unified moulding.

10. An instrument according to claim 1, wherein said flexible membrane is protected by a cover-plate.

11. An instrument according to claim 10, wherein said bridge extends through a hole in said cover-plate.

12. An instrument according to claim 8, wherein a spongy material is located within said ringed structure.

13. A method of fabricating a stringed musical instrument having a plurality of strings, securing means for securing ends of said strings and a bridge for supporting said strings, said method comprising the steps of supporting a flexible membrane within a housing for the musical instrument;

placing at least one transducer in physical contact with said membrane such that it is held between said membrane and said floating bridge; and configuring said membrane so as to reduce the influence of ambient acoustics.

14. A method according to claim 13, wherein said bridge is configured to provide a plurality of supports, and said transducer or transducers are placed between at least one of said supports and said membrane.

15. A method according to claim 13, wherein said bridge is configured to provide end supports and said transducer is placed between one of said supports and said membrane.

16. A method according to claim 13, wherein said bridge is configured to provide two end supports and a respective transducer is positioned between each of said supports and said membrane.

17. A method according to claim 13, wherein the overall size of said membrane is smaller than a size of a similar acoustic instrument.

18. A method according to claim 13, wherein the thickness of the membrane is larger than a thickness of a similar acoustic instrument.

19. A method according to claim 13, wherein said membrane is fabricated from a plastics material.

20. A method according to claim 13, wherein said plastics membrane is mounted on or within a ringed structure to form a resonating drum.

21. A method according to claim 19, wherein said membrane is moulded in combination with a ringed structure to form a resonating drum as a unified moulding.

22. A method according to claim 13, wherein a cover-plate is attached to said musical instrument and said cover-plate is configured to protect said membrane.

23. A method according to claim 22, wherein a hole is created in said cover-plate and said hole is configured to allow said bridge to extend through said cover-plate.

24. A method according to claim 22, wherein a spongy material is placed within said ringed structure.

25. An instrument according to claim 1, wherein said transducers are piezoelectric transducers.

26. A method of fabricating a stringed musical instrument according to claim 13, wherein said transducers are piezoelectric transducers.

* * * * *